US009052674B2

(12) United States Patent
Souda

(10) Patent No.: US 9,052,674 B2
(45) Date of Patent: Jun. 9, 2015

(54) IMAGE FORMING APPARATUS WITH METAL AND RESIN FRAME COMPONENTS

(71) Applicant: Makoto Souda, Nagoya (JP)

(72) Inventor: Makoto Souda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/032,438

(22) Filed: Sep. 20, 2013

(65) Prior Publication Data

US 2014/0086614 A1 Mar. 27, 2014

(30) Foreign Application Priority Data

Sep. 21, 2012 (JP) ..... 2012-207701

(51) Int. Cl.

| | |
|---|---|
| ***G03G 15/00*** | (2006.01) |
| ***G03G 15/01*** | (2006.01) |
| ***G03G 21/16*** | (2006.01) |
| ***G03G 21/18*** | (2006.01) |

(52) U.S. Cl.

CPC ..... *G03G 15/757* (2013.01); *G03G 15/80* (2013.01); *G03G 15/0178* (2013.01); *G03G 21/1623* (2013.01); *G03G 21/1647* (2013.01); *G03G 21/1857* (2013.01)

(58) Field of Classification Search

CPC ..... G03G 15/0178; G03G 21/1623; G03G 15/80; G03G 21/1857; G03G 15/757; G03G 21/1647

USPC ..... 399/90, 107, 167

See application file for complete search history.

(56) References Cited

U.S. PATENT DOCUMENTS

| | | | |
|---|---|---|---|
| 6,839,532 | B2 | 1/2005 | Hoashi |
| 8,160,472 | B2 | 4/2012 | Tomatsu |
| 8,170,446 | B2 | 5/2012 | Matsui et al. |
| 2003/0053819 | A1 * | 3/2003 | Nomura et al. |
| 2003/0103780 | A1 | 6/2003 | Hoashi |
| 2009/0317125 | A1 * | 12/2009 | Tomatsu |
| 2009/0317126 | A1 | 12/2009 | Tomatsu |
| 2011/0116830 | A1 | 5/2011 | Matsui et al. |
| 2011/0123217 | A1 | 5/2011 | Matsui et al. |
| 2011/0123246 | A1 | 5/2011 | Ando et al. |
| 2011/0280614 | A1 | 11/2011 | Yamauchi et al. |

FOREIGN PATENT DOCUMENTS

| | | | |
|---|---|---|---|
| JP | 2003-107822 | A | 4/2003 |
| JP | 2003-167411 | A | 6/2003 |
| JP | 2004-045923 | A | 2/2004 |

(Continued)

*Primary Examiner* — Susan Lee

(74) *Attorney, Agent, or Firm* — Banner & Witcoff, Ltd.

(57) ABSTRACT

An image forming apparatus includes a main body including an image forming unit including an image carrying member, a drive force transmission mechanism configured to transmit a drive force to the image carrying member, and a main body configured to support the image forming unit. The main body includes a first frame disposed on a first side of the image carrying member in an axial direction of the image carrying member, a second frame disposed on a second side of the image carrying member opposite to the first side thereof, a first connecting member extending in the axial direction of the image carrying member and connecting the first frame and the second frame, and a second connecting member spaced apart from the first connecting member and connecting the first frame and the second frame. The first frame is made of metal and the second frame is made of resin.

15 Claims, 7 Drawing Sheets

(56) References Cited

FOREIGN PATENT DOCUMENTS

| | | | | |
|---|---|---|---|---|
| JP | 2008068629 | A | * | 3/2008 |
| JP | 2010-002626 | A | | 1/2010 |
| JP | 2011-107557 | A | | 6/2011 |
| JP | 2011107557 | A | * | 6/2011 |
| JP | 2011-145357 | A | | 7/2011 |
| JP | 2011-237641 | A | | 11/2011 |

* cited by examiner

IMAGE FORMING APPARATUS WITH METAL AND RESIN FRAME COMPONENTS

CROSS REFERENCE TO RELATED APPLICATION

This application claims priority from Japanese Patent Application No. 2012-207701, filed on Sep. 21, 2012, which is incorporated herein by reference in its entirety.

FIELD

Aspects of the disclosure relate to an image forming apparatus including a main body supporting an image forming unit including an image carrying member.

BACKGROUND

Generally, an image forming apparatus, e.g., a laser printer, includes a main body supporting an image forming unit including a photosensitive drum. In a known image forming apparatus, the main body includes a substantially box-shaped main body frame comprised of a pair of metal frames supporting the image forming unit and a pair of resin frames each supporting a corresponding one of metal frames from below.

SUMMARY

However, the metal frames are sized to entirely cover the side surfaces of the image forming unit and thus the main body is heavy in weight. To reduce the weight of the image forming apparatus, the main body may be formed of resin. However, resin has a higher coefficient of thermal expansion than metal has, and thus resin is likely to lead to the dimensional change due to the temperature change. The main body made of resin would be difficult to accurately maintain the position of, for example, a drive force transmission mechanism comprised of gears.

Illustrative aspects of the disclosure provide an image forming apparatus configured to accurately maintain the position of a drive power transmission mechanism including gears while achieving weight reduction.

According to an aspect of the disclosure, an image forming apparatus includes an image forming unit including an image carrying member, a drive force transmission mechanism configured to transmit a drive force to the image carrying member, and a main body configured to support the image forming unit. The main body includes: a first frame disposed on a first side of the image carrying member in an axial direction of the image carrying member, the first frame supporting the drive force transmission mechanism, a second frame disposed on a second side of the image carrying member opposite to the first side thereof, the second frame and the first frame facing each other; a first connecting member extending in the axial direction of the image carrying member and connecting the first frame and the second frame; and a second connecting member spaced apart from the first connecting member and connecting the first frame and the second frame. The first frame of the main body is made of metal and the second frame of the main body is made of resin.

With this structure, the positional accuracy of the drive force transmission mechanism can be maintained as the drive force transmission mechanism is supported by the first frame made of metal. As the second frame is made of resin, the weight of the image forming apparatus can be reduced.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. In the following description, a general structure of a color laser printer 1, as an example of an image forming apparatus, will be described in detail.

In the following description, orientations or sides of the color laser printer 1 will be identified based on the color laser printer disposed in an orientation in which it is intended to be used. In other words, in FIG. 1, the left side is referred to as the front or front side, the right side is referred to as the rear or the rear side, the up side is referred to as the top or upper side, and the down side is referred to as the bottom or lower side. The top-bottom direction may be referred to as a vertical direction.

Figure 1:
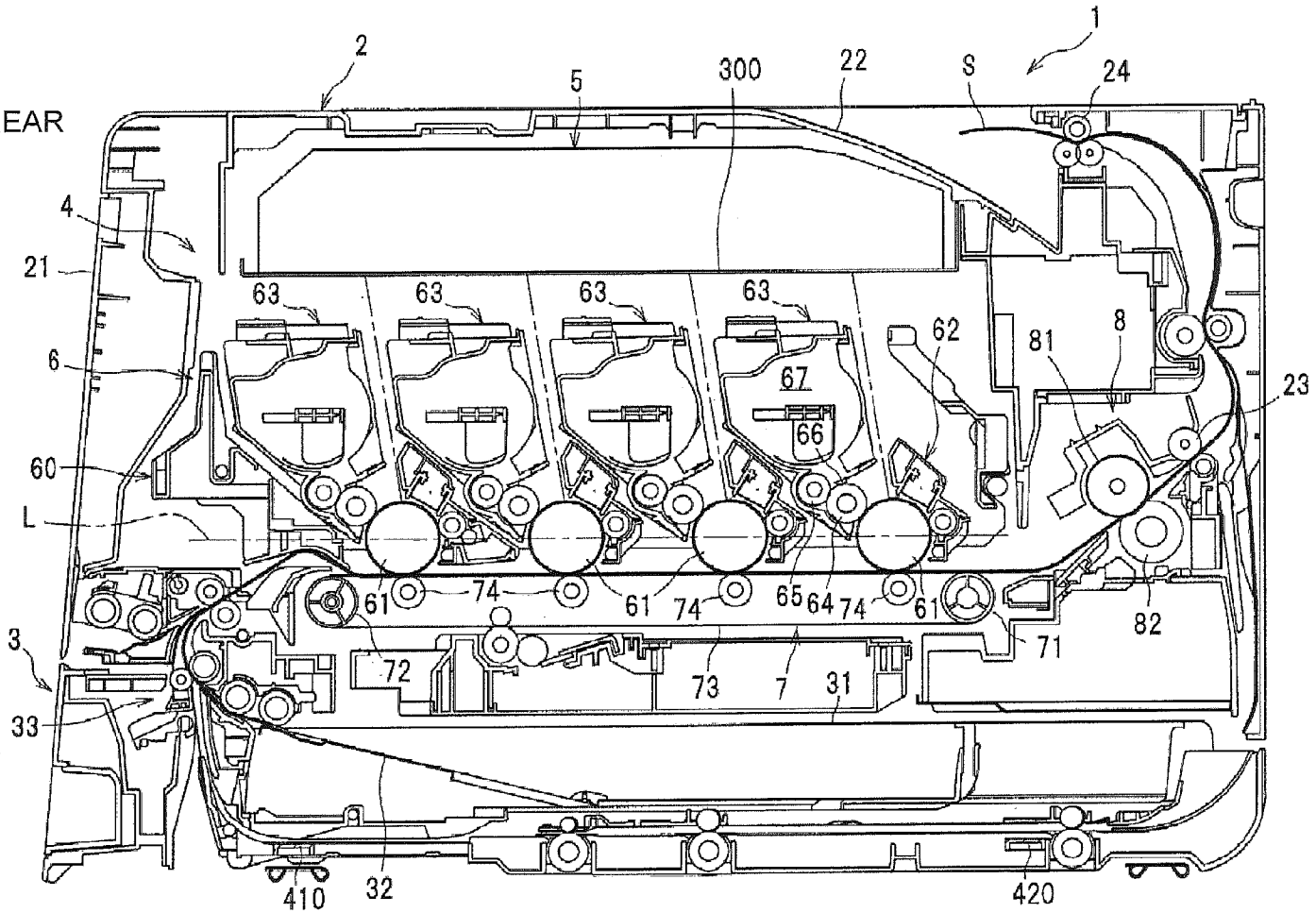
FIG. 1 is a sectional view of an illustrative image forming apparatus, e.g. a color laser printer, according to an embodiment of the disclosure.

As shown in FIG. 1, the color laser printer 1 includes a main casing 2 as an example of a main body, a sheet feed portion 3 configured to feed a sheet S, and an image forming portion 4 configured to form an image on the sheet S fed thereto. The image forming portion 4 mainly includes a light exposure unit 5, a process unit 6 as an example of an image forming unit, a transfer unit 7 and a fixing unit 8.

The sheet feed portion 3 is disposed in a lower portion of the main casing 2, and mainly includes a sheet tray 31 configured to accommodate sheets S therein, a sheet pressing plate 32, and a sheet feeding mechanism 33 configured to feed a sheet S from the sheet tray 31 to the image forming portion 4. The sheets S in the sheet tray 31 are raised at their front ends by the sheet pressing plate 32, and singly separated and fed to the image forming portion 4 by the sheet feeding mechanism 33.

The light exposure unit 5 is disposed in an upper portion of the main casing 2 and includes plural laser light sources, a polygon mirror, plural lenses, and plural reflecting mirrors, which are not shown. Laser light emitted from the laser light sources based on image data is reflected at the polygon mirror and the reflecting mirrors, passes through the lenses, and irradiates a surface of each photosensitive drum 61 as shown by a chain line.

The process unit 6 is disposed between the sheet tray 31 and the light exposure unit 5, and mainly includes a holder 60, four photosensitive drums 61 arranged along the front-rear direction, and chargers 62 and developing cartridges 63 corresponding to the photosensitive drums 61. Each of the developing cartridges 63 includes a developing roller 64, a supply roller 65, a layer thickness regulating blade 66, and a toner storing portion 67 configured to store toner.

Figure 2:
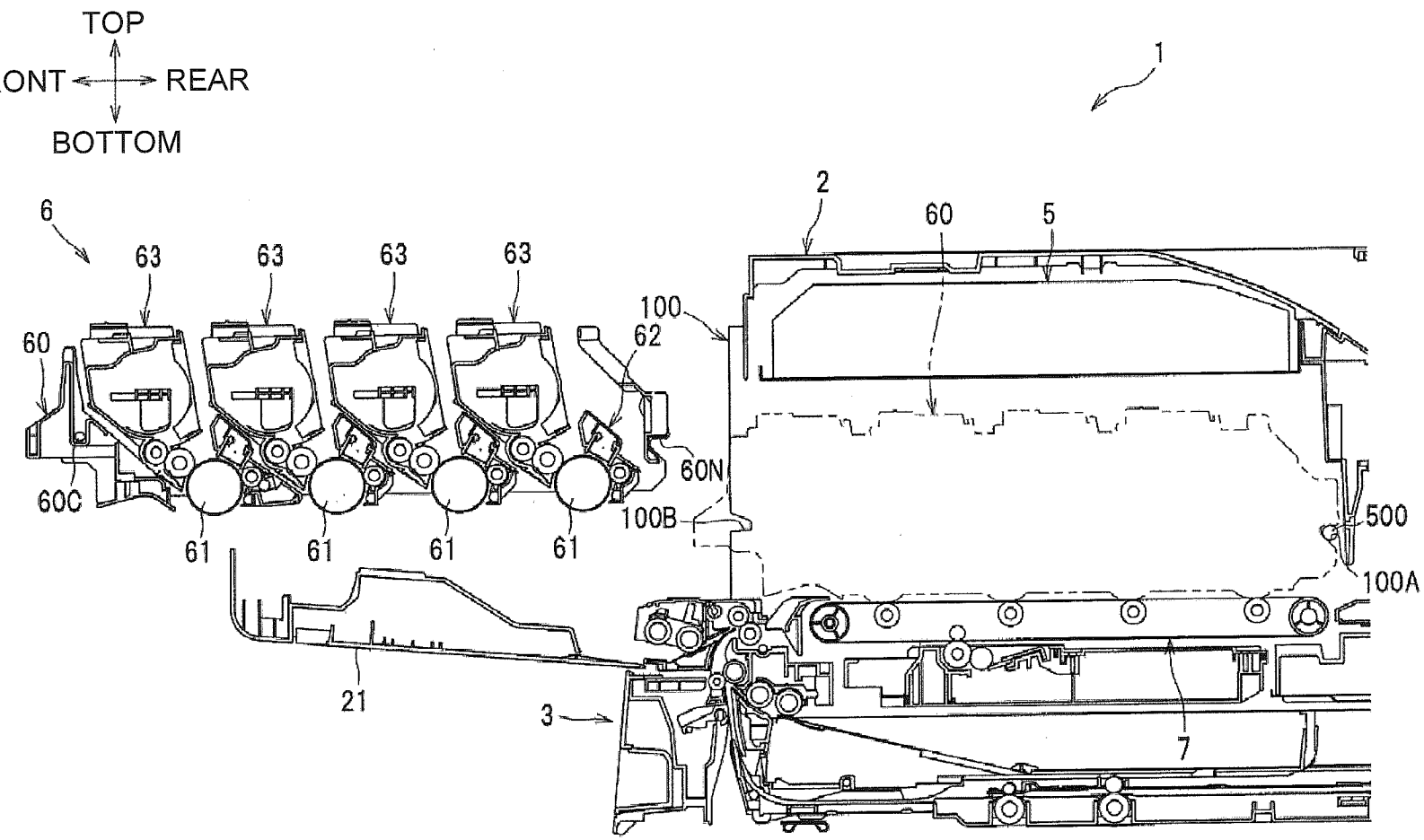
FIG. 2 illustrates that a process unit is pulled out from a main body.

The holder 60 is configured to hold the photosensitive drums 61, and supported by the main casing 2 movably in the front-rear direction. As shown in FIG. 2, when a front cover 21, which is disposed on a front side of the main casing 2, is open, the holder 60 or the process unit 6 is movable from an inside position where the holder 60 is mounted in the main casing 2, shown by a double dotted line, to an outside position where the holder 60 is pulled out from the main casing 2, shown by a solid line. The developing cartridges 63 are detachably held by the holder 60 and replaceable when the holder 60 is in the outside position.

Returning to FIG. 1, the transfer unit 7 is disposed between the sheet tray 31 and the process unit 6, and mainly includes a drive roller 71, a driven roller 72, a conveyor belt 73, and four transfer rollers 74. The conveyor belt 73 is endless, extends between the drive roller 71 and the driven roller 72, and contacts the photosensitive drums 61 at its outer surface. The transfer rollers 74 are disposed inside the conveyor belt 73 such that the conveyor belt 73 is sandwiched between the transfer rollers 74 and the photosensitive drums 61.

The fixing unit 8 is disposed at the rear of the process unit 6 and the transfer unit 7, and mainly includes a pressure roller 81 and a pressure roller 82 disposed opposite to the heat roller 81 and configured to press the heat roller 81.

In the image forming portion 4, the surface of each photosensitive drum 61 is uniformly charged by a corresponding charger 62, and subsequently exposed to laser light from the light exposure unit 5 by high speed scanning. Thus, the charges in an exposed area of each photosensitive drum 61 are removed, and an electrostatic latent image based on image data is formed on the surface of each photosensitive drum 61. Then, toner stored in the toner storing portion 67 is supplied to the developing roller 64 via the supply roller 65, enters in between the developing roller 64 and the layer thickness regulating blade 66, and is carried on the developing roller 64 as a thin layer having a fixed thickness.

The toner carried on the developing roller 64 is supplied onto the electrostatic latent image formed on the corresponding photosensitive drum 61, thereby the electrostatic latent image is developed into a visible image such that a toner image is formed on the photosensitive drum 61. Then, when a sheet S is supplied from the sheet feed portion 3 and fed in between each of the photosensitive drums 61 and the conveyor belt 73, the toner images carried on the surfaces of the photosensitive drums 61 are sequentially transferred onto the sheet S.

The sheet S having the toner images transferred thereto passes between the heat roller 81 and the pressure roller 82 and the toner images transferred onto the sheet S are thermally fixed. The sheet S having the toner images thermally fixed is ejected outside from the main casing 2 by feed rollers 23 and ejection rollers 24, which are disposed in the main casing 2, and received onto an ejection tray 22.

The structure of the main casing 2 will be described in detail.

Figure 3:
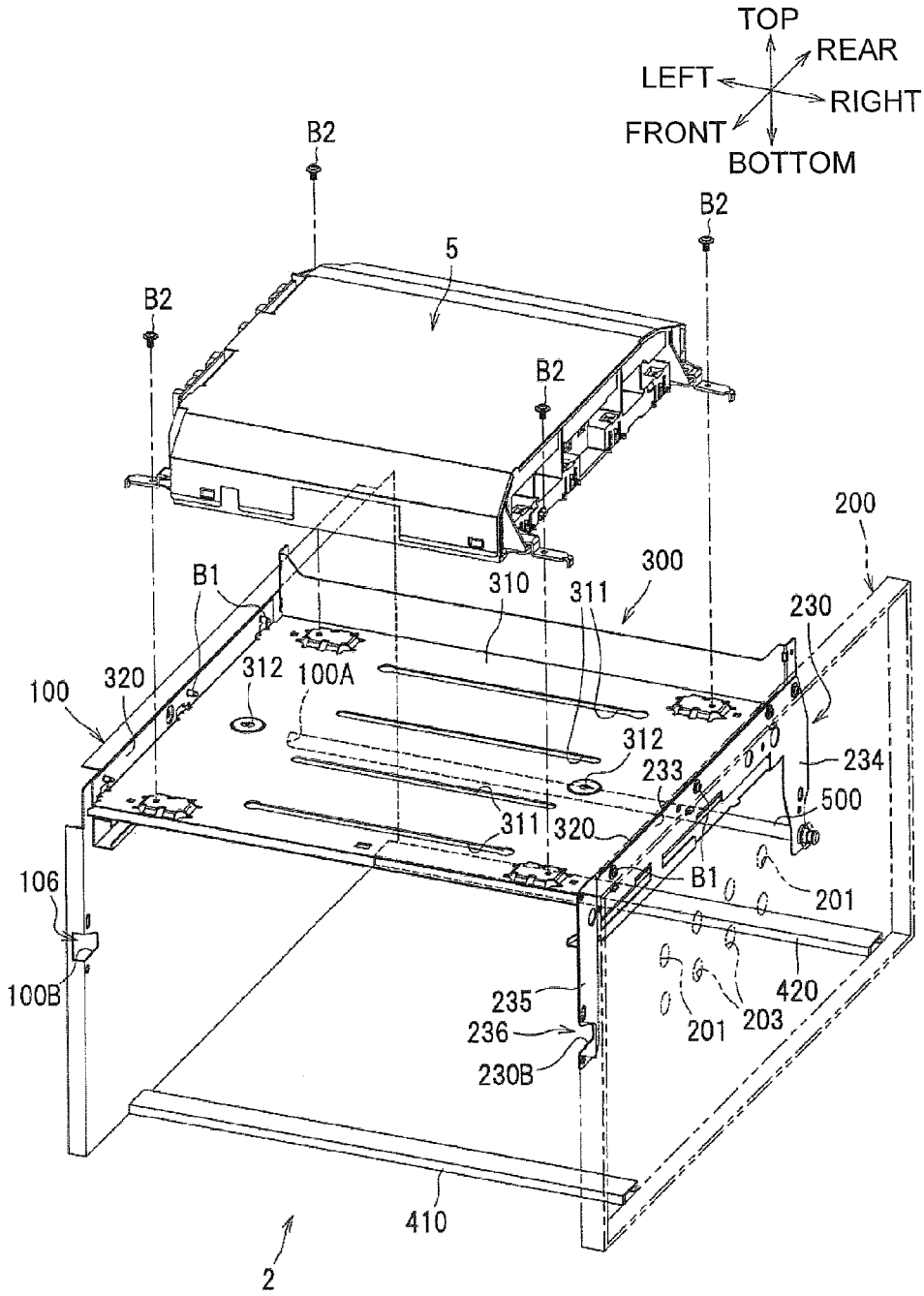
FIG. 3 is an exploded perspective view illustrating the main body and a light exposure unit.

As shown in FIG. 3, the main casing 2 has a frame body mainly including a first frame 100, a second frame 200, a scanner plate 300 as an example of a first connecting member, which supports the light exposure unit 5, a front beam 410 as an example of a second connecting member, and a rear beam 420. The main casing 2 is made by covering the frame body with exteriors (not shown) to give the appearance of the color laser printer 1.

Figure 4:
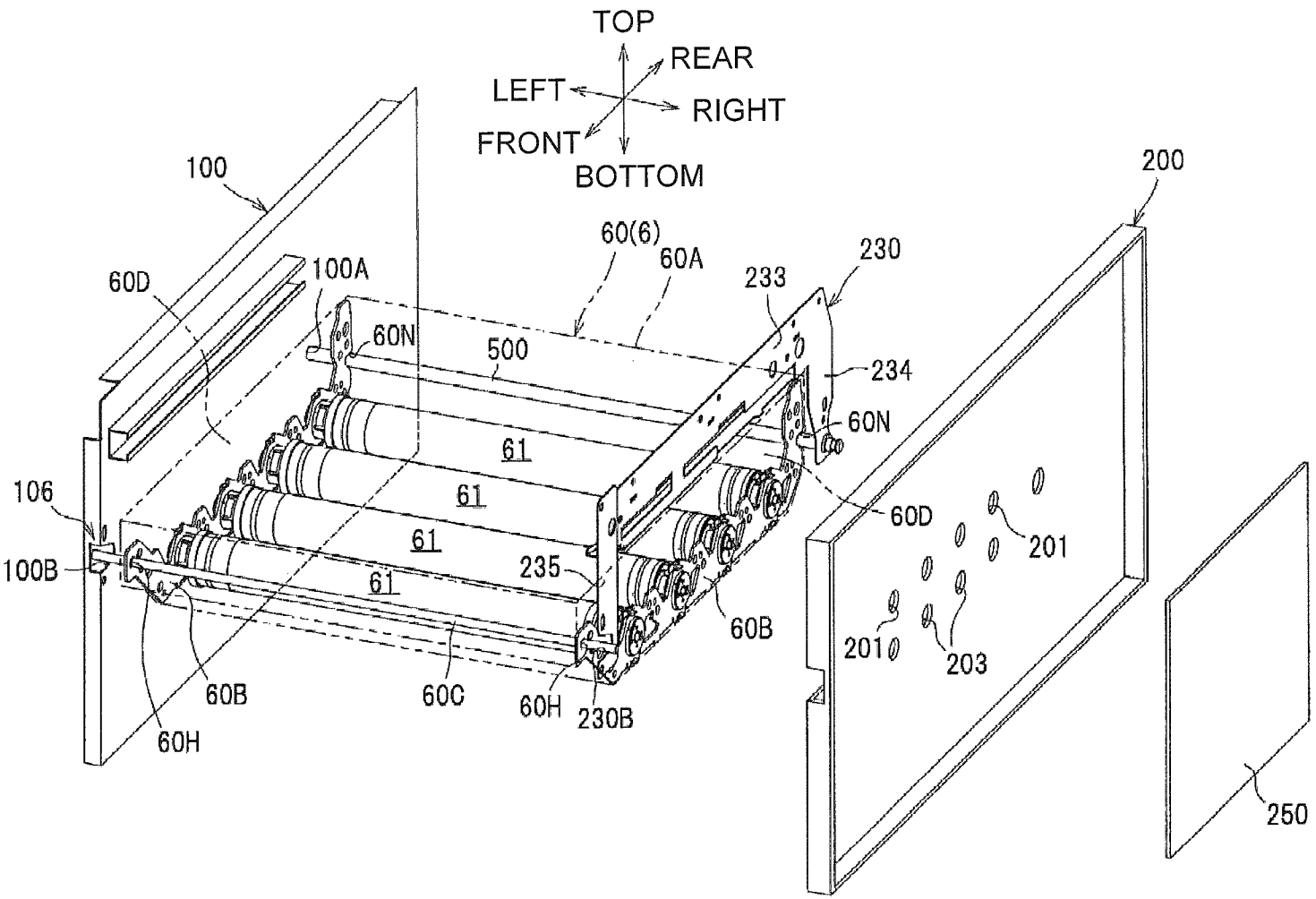
FIG. 4 is a perspective view illustrating a first frame, the process unit, a metal frame, a second frame, and a board.
Figure 5:
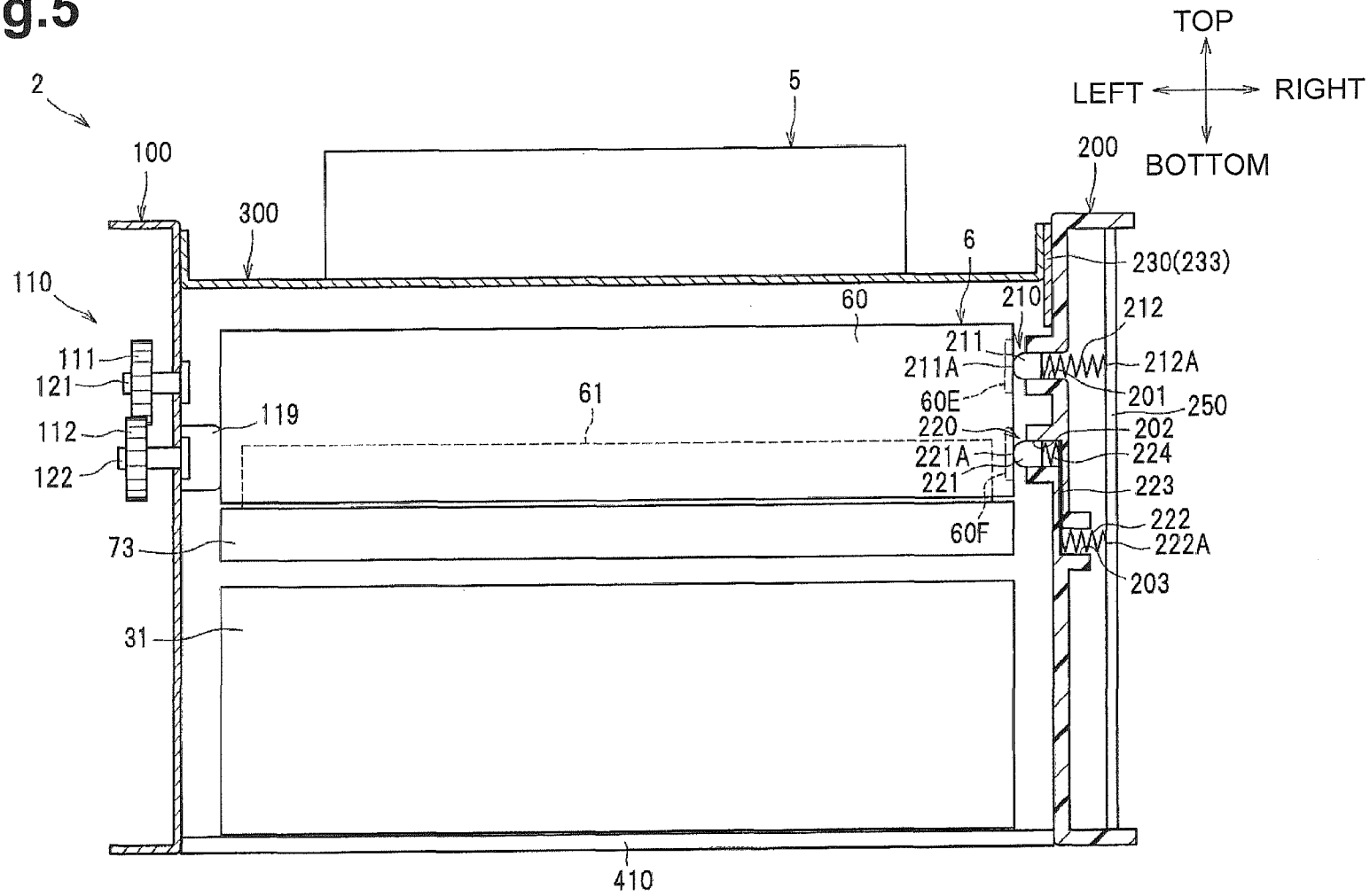
FIG. 5 is a sectional side view of the main body.

As shown in FIG. 4, the first frame 100 is disposed on the left side, as one side in an axial direction, of the photosensitive drum 61. The first frame 100 is formed by bending a metal frame such as a galvanized metal plate. As shown in FIG. 5, the first frame 100 is provided with a drive force transmission mechanism 110 for transmitting a drive force to the process unit 6, e.g., the photosensitive drums 61 and the developing cartridges 63.

The drive force transmission mechanism 110 includes plural gears for transmitting a drive force from a motor (not shown) to the process unit 6, and a known coupling 119 for inputting the drive force from a gear train composed of the plural gears to the process unit 6. FIG. 5 illustrates gears 111, 112 only of the plural gears. Detailed descriptions as to the arrangement of the plural gears constituting the drive force transmission mechanism 110 and the structure for inputting the drive force from the gear train to the coupling 119 are omitted because they can be realized by known methods.

The first frame 100 is provided with plural gear shafts corresponding to the gears constituting the drive force transmission mechanism 110. The gear shafts are configured to position the gears and rotatably support the gears. FIG. 5 illustrates gear shafts 121 and 122 only of the gear shafts. The gear shafts 121 and 122 are crimped at one end to the first frame 100 such that they pass through the first frame 100 and protrude outward therefrom at the other end.

As shown in FIG. 3, the second frame 200 is disposed on the right side, as the other side in the axial direction, of the photosensitive drum 61. The second frame 200 is disposed opposite to the first frame 100. The second frame 200 is made by injecting resin having electrical insulation property such as acrylonitrile butadiene styrene (ABS) into a mold. The first frame 100 and the second frame 200 are sized such that their front-rear and top-bottom dimensions include the sheet feed portion 3 and the image forming portion 4 within a projected plane when viewed from the left-right direction, which is an axial direction of the photosensitive drum 61. The first frame 100 and the second frame 200 have the largest size among structural members constituting the left and right sidewalls of the color laser printer 1.

As shown in FIG. 5, the second frame 200 is provided with a first electrode 210 and a second electrode 220 for supplying power to the process unit 6 or, more specifically, for applying a specified bias to the chargers 62 and the developing rollers 64. Although FIG. 5 illustrates that the second frame 220 is provided with one first electrode 210 and one second electrode 220, the second frame 200 is actually provided with plural first electrodes 210 and plural second electrodes 220 for each of the chargers 62 and the developing rollers 64.

The first electrode 210 has a unit-side contact member 211 and a board-side contact member 212. The unit-side contact member 211 has a tubular shape of which left end portion has substantially a semi-circular shape and right end portion has a flat surface. The board-side contact member 212 is wound into coil form and electrically connected to the right end portion of the unit-side contact member 211. The second frame 200 has an electrode holding portion 201 which is a hole formed through the second frame 200 in the left-right direction. The unit-side contact member 211 is held by the electrode holding portion 201 such that the unit-side contact member 211 protrudes at its left end from the second frame 200 and is movable in the left-right direction along an inner peripheral surface of the electrode holding portion 201.

A board 250 for controlling bias to be applied to the process unit 6 is fixed to the second frame 200 on the right side thereof, which is opposite to the process unit 6. The first electrode 210 is electrically connected via the electrode holding portion 201 to the board 250 as a board-side contact portion 212A, which is disposed on the right end of the board-side contact member 212, is electrically connected to the board 250.

The first electrode 210 is electrically connected to the process unit 6 and is allowed to apply bias from the board 250 to the process unit 6 as a unit-side contact portion 211A, which is disposed on the left end of the unit-side contact member 211, contacts a holder-side first electrode 60E, which is disposed on the right sidewall of the holder 60 mounted in the main casing 2. The board-side contact member 212 has elasticity and thus the first electrode 210 elastically contacts the holder-side first electrode 60E.

The second electrode 220 is disposed below the first electrode 210 and has a unit-side contact member 221, a board-side contact member 222, a conductive plate 223 and a conductive spring 224. The unit-side contact member 221 has a tubular shape of which left end portion has substantially a semi-circular shape and right end portion has a flat surface. The board-side contact member 222 is wound into coil form. The conductive plate 223 and the conductive spring 24 are an example of an electrically conductive portion. The second frame 200 has an electrode holding portion 202 which is a recessed portion formed on a side of the second frame 200 facing the process unit 6. The unit-side contact member 221 is held by the electrode holding portion 202 such that the unit-side contact member 221 protrudes at its left end from the second frame 200 and is movable in the left-right direction along an inner peripheral surface of the electrode holding portion 202. The left end of the board-side contact member 222 is disposed in a recessed portion 203 formed on a side of the second frame 200 facing the board 250. A board-side contact portion 222A, which is disposed on the right end portion of the board-side contact member 222, is electrically connected to the board 250.

The conductive plate 223 is embedded in the second frame 200 and disposed along the board 250. The bottom end of the conductive plate 223 is exposed at the bottom of the recessed portion 203 and is electrically connected to the left end portion of the board-side contact member 222. The upper end of the conductive plate 223 is exposed at the bottom of the electrode holding portion 202 and is electrically connected to the unit-side contact member 221 via the conductive spring 224. With this structure, the unit-side contact member 221 and the board-side contact member 222 are electrically continuous with each other and disposed at positions shifted from each other in the left-right direction or, more specifically, shifted vertically.

The second electrode 220 is electrically connected to the process unit 6 and is allowed to apply bias from the board 250 to the process unit 6 as a unit-side contact portion 221A, which is disposed on the left end of the unit-side contact member 221, contacts a holder-side second electrode 60F, which is disposed on the right sidewall of the holder 60 and below the holder-side first electrode 60E. The conductive spring 224 has elasticity and thus the unit-side contact member 221 elastically contacts the holder-side second electrode 60F.

Figure 6:
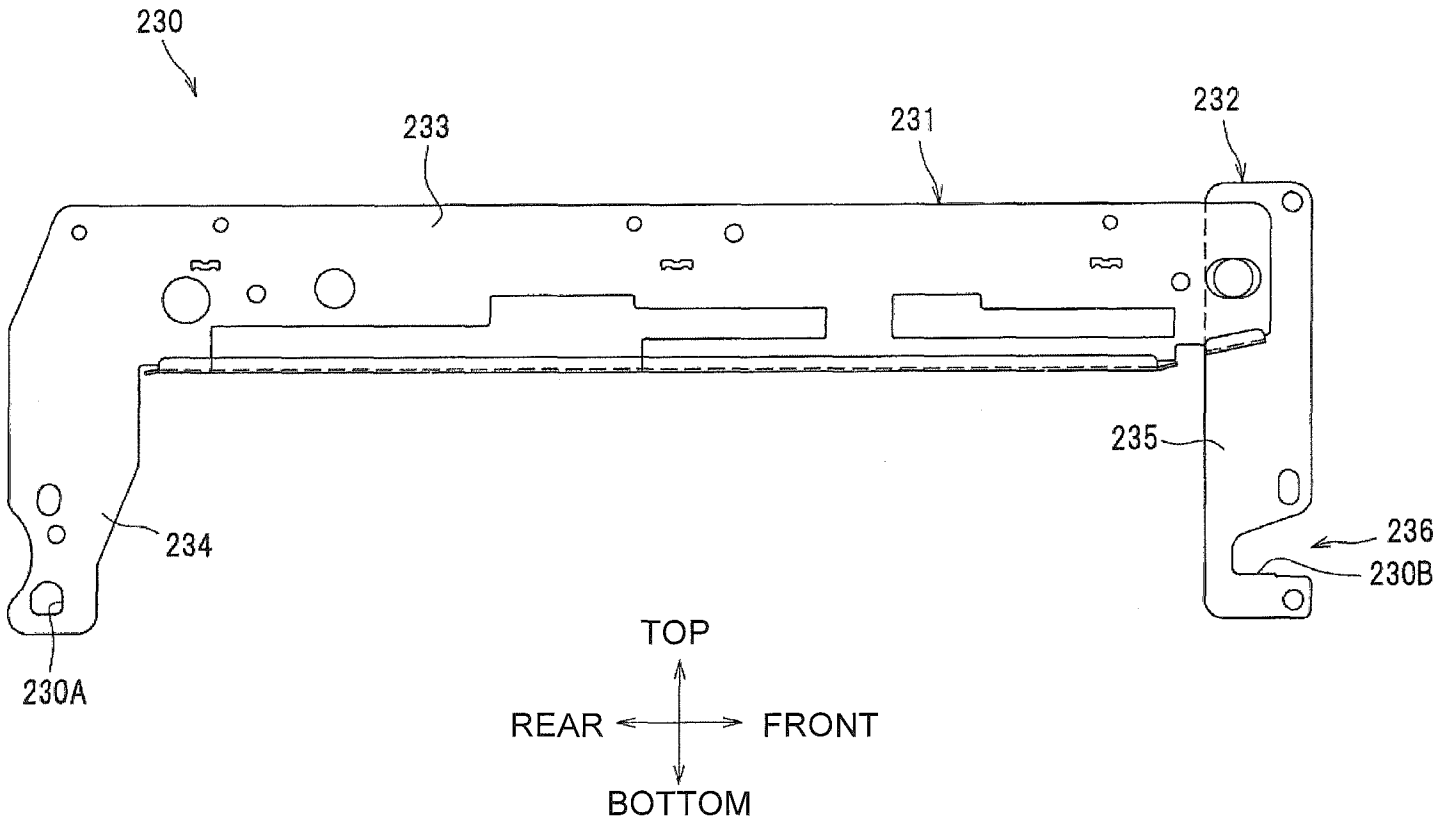
FIG. 6 illustrates the metal frame.

As shown in FIGS. 3 and 4, a metal frame 230 is fixed on the left surface of the second frame 200 where the photosensitive drums 61 are to be disposed. The metal frame 230 is made of a metal sheet, e.g. galvanized sheet iron. As shown in FIG. 6, the metal frame 230 is made up of an L-shaped first metal frame 231 and an I-shaped second metal frame 232, and a front portion of the first metal frame 231 overlaps an upper portion of the second metal frame 232.

The metal frame 230 has a main body portion 233 and a pair of extension portions 234 and 235. The main body portion 233 is comprised of upper portions of the first and second metal frames 231 and 232 and elongated in the front-rear direction. The extension portions 234 and 235 extend downward from respective ends of the main body portion 233 in the front-rear direction. When the metal frame 230 is fixed on the inner surface of the second frame 200 as shown in FIG. 3, the main body portion 233 is disposed above the electrode holding portions 201 for holding the first electrodes 210. The main body portion 233 has screw holes (reference numerals omitted in FIG. 6) for securing the metal frame 230 to the second frame 200 and fixing the scanner plate 300.

As shown in FIGS. 4 and 6, as an example of a positioning portion for positioning the holder 60 mounted in the main casing 2, the first frame 100 has a positioning hole 100A and a positioning surface 100B and the metal frame 230 has a positioning hole 230A and a positioning surface 230B.

The positioning hole 100A is a hole formed through the first frame 100 and the positioning hole 230A is a hole formed through the metal frame 230 in a lower portion of the rear-side extension portion 234. The positioning holes 100A and 230A are disposed in the same position in the front-rear direction and the top-bottom direction and receive ends of a metal shaft 500 respectively. The shaft 500 is fixed at its ends to the first frame 100 and the metal frame 230 such that it extends in substantially a horizontal direction.

The positioning surface 100B is a bottom of a recessed portion 106 which is disposed at the front end of the first frame 100 and open toward the front side. The positioning surface 230B is a bottom of a recessed portion 236 which is disposed at the front end of the front-side extension portion 235 of the metal frame 230 and open toward the front side. The positioning surfaces 100B and 230B are disposed at the same position in the front-rear direction and the top-bottom direction and extend in substantially a horizontal direction.

The following will describe the structure of the holder 600 to be positioned by the positioning holes 100A and 230A and the positioning surfaces 100B and 230B.

As shown in FIG. 4, the holder 60, which is indicated by a two-dot chain line, mainly includes a resin-made holder frame 60A, which is an open-topped and open-bottomed box like member, a pair of side plates 60B disposed on both sides of the photosensitive drums 61 in an axial direction thereof, and a rod-like positioning shaft portion 60C.

The left and right side plates 60B are formed of metal sheets, e.g. galvanized sheet iron. The side plates 60B are fixed on inner surfaces of holder side walls 60D, which are left and right walls of the holder frame 60A, to position the four photosensitive drums 61 in the front-rear direction by maintaining intervals between the photosensitive drums 61 in a direction where the photosensitive drums 61 are arranged. A rear end of each of the side plates 60B has a cut-out portion 60N, which is open toward the rear side. The positioning shaft portion 60C passes through the left and right side plates 60B and sidewalls 60D and protrudes outward from the front end portions of the left and right sidewalls 60D. The positioning shaft portion 60C is engaged in through holes 60H formed in the front end portions of the left and right side plates 60B and is fixed in position by the side plates 60B.

Figure 7A:
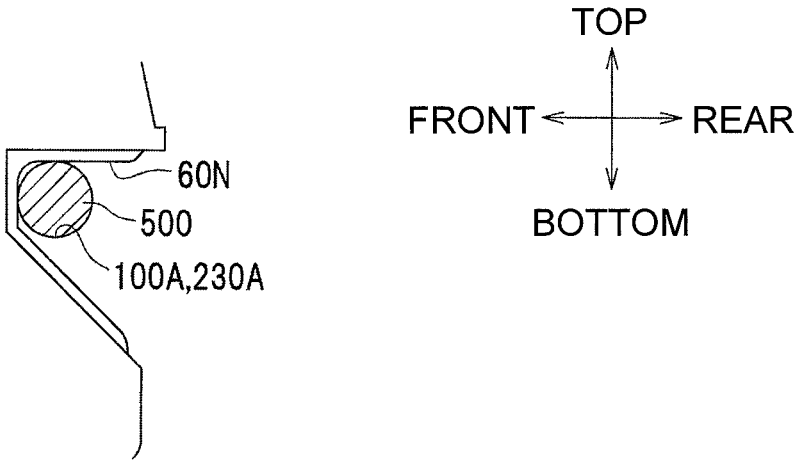
FIG. 7A illustrates a recessed portion of a holder engages a shaft.
Figure 7B:
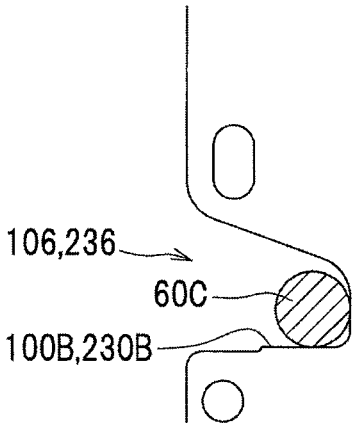
FIG. 7B illustrates a positioning shaft of the holder contacts a positioning surface.

When the holder 60 is mounted in the main casing 2, the cut-out portion 60N is engaged with the shaft 500 as shown in FIG. 7A, and the positioning shaft portion 60C contacts the positioning surfaces 100B and 230B from above as shown in FIG. 7B. Thus, as shown in FIG. 4, the holder 60 or the process unit 6 is positioned by the positioning holes 100A and 230A and the positioning surfaces 100B and 230B, and supported by the first frame 100 and the second frame 200 to which the metal frame 230 is fixed. The four photosensitive drums 61 are supported via the holder 60 by the first frame 100 and the second frame 200.

As shown in FIG. 3, the scanner plate 300, the front beam 410, and the rear beam 420 are members for connecting the first frame 100 and the second frame 200, and each formed by bending a metal frame such as a galvanized metal plate. More specifically, the scanner plate 300 connects the upper portions of the first frame 100 and the second frame 200 via the metal frame 230. The front beam 410 connects front lower portions of the first frame 100 and the second frame 200, and the rear beam 420 connects the rear lower portions of the first frame 100 and the second frame 200. As shown in FIG. 1, the scanner plate 300 is disposed opposite to the front beam 410 and the rear beam 420 with respective to a line L passing the axes of the four photosensitive drums 61 when viewed in the left-right direction.

Returning to FIG. 3, the scanner plate 300 mainly includes a plate-like portion 310 extending so as to connect the first frame 100 and the second frame 200, and a pair of fixing portions 320 extending upward from the left and right ends of the plate-like portion 310. The fixing portions 320 are fixed to the first frame 100 and the metal frame 230 with screws B1. The plate-like portion 310 is provided with four slit-like openings 311 elongated in the left-right direction. Four streaks of laser light, which are indicated with chain lines in FIG. 1 and emitted from the light exposure unit 5, pass through the openings 311 to expose the photosensitive drums 61 respectively. The plate-like portion 310 is formed with two circular positioning holes 312, which are spaced apart from each other in the left-right direction and substantially centered in the front-rear direction. The positioning holes 312 is configured to engage positioning bosses (not shown) provided on the lower surface of the light exposure unit 5.

The light exposure unit 5 is positioned relative to the main body 2 by engaging the positioning bosses (not shown) provided on the lower surface of the light exposure unit 5 in the positioning holes 312 formed in the plate-like portion 310. The light exposure unit 5 is fixed on an upper surface of the plate-like portion 310 with screws B2 and supported by the first frames 100 and the second frame 200 via the scanner plate 300.

The front beam 410 and the second beam 420 are substantially U-shaped in cross section, and fixed to the first frame 100 and the second frame 200 by welding and with screws, which are not shown.

According to the color laser printer 1 described in the above embodiment, the following effects can be obtained.

As shown in FIG. 5, the first frame 100, to which the drive force transmission mechanism 110 is attached, is made of metal having a smaller coefficient of thermal expansion and higher stiffness than resin. Thus, the positional accuracy of the drive force transmission mechanism 100 can be maintained. The second frame 200 is made of resin which is lighter than metal, and thus contributes to a reduced weight of the color laser printer 1.

The first and second electrodes 210 and 220 are attached to the second frame 200. As the second frame 200 is made of resin, a structure for insulation can be simplified compared with a case where the electrodes are attached to a metal frame. Thus, the structure of the color laser printer 1 can be simplified and the manufacturing cost of the color laser printer 1 can be reduced.

As the board 250 is disposed on the side of the second frame 200 opposite to the process unit 6, the insulation between the board 250 and the process unit can be assured by the second frame 200. The first electrode 210 is held by the electrode holding portion 201 formed through the second frame 200 and connected to the board 250 via the electrode holding portion 201. Thus, the insulation between the process unit 6 and the board 250 can be assured and structures for holding the first electrode 210 and connecting it to the board 250 can be simplified.

The unit-side contact member 221 and the board-side contact member 222 of the second electrode 220, or more specifically, the unit-side contact portion 221A and the board-side contact member 222A are disposed at positions shifted vertically, which can provide a high degree of flexibility in structures and dispositions of the process unit 6 and the board 250. Thus, the flexibility of design of the color laser printer 1 can be enhanced.

The first frame 100 is provided with gear shafts 121, 122 supporting the gears 111, 112 of the drive force transmission mechanism 110. Compared with a case where a metal frame provided with gear shafts is fixed to the first frame 100, the number of parts can be reduced, and the weight of the color laser printer 1 can be reduced.

As the color laser printer 1 includes plural photosensitive drums 61, the first frame 100 and the second frame 200 are inevitably large in size as shown in FIG. 4. However, as the second frame 200 is made of resin, the weight of the color laser printer 1 can be reduced effectively. Similarly, as the drive force transmission mechanism 110 is also inevitably large in size, its positional accuracy can be maintained by the first frame 100 made of metal.

The photosensitive drums 61 are supported by the first frame 100 and the second frame 200 via the holder 60. This structure limits on effects to the photosensitive drums 61 due to difference in coefficient of thermal expansion between the first frame 100 and the second frame 200 compared with a case where the photosensitive drums are supported directly by the first frame and the second frame made of different materials.

In the embodiment, the four photosensitive drums 61 are maintained at regular intervals by the side plates 60B. Even if the side plates 60B expands with heat and the intervals between the photosensitive drums 61 are changed, the change of the intervals can be made equal on the left and right sides of the photosensitive drums 61. This can minimize effects caused by the change in the intervals of the photosensitive drums 61.

In the embodiment, the side plates 60B are made of metal having small coefficient of thermal expansion, and thus limit the change of the intervals between the photosensitive drums 61 due to the temperature change.

The positioning holes 100A, 230A and the positioning surfaces 100B, 230B are formed in the first frame 100 and the metal frame 230 fixed on the inner surface of the second frame 200, which are made of metal having small coefficient of thermal expansion and high stiffness. Thus, the holder 60, or more specifically, the photosensitive drums 61 can be positioned accurately with respect to the main body 2.

The photosensitive drums 61 are supported by the first frame 100 and the second frame 200 via the holder 60, and the light exposure unit 5 is supported by the first frame 100 and the metal frame 230 via the scanner plate 300. The photosensitive drums 61 and the light exposure unit 5 are supported by the metal members, and thus positioned with accuracy.

The above embodiment shows, but is not limited to, that the first frame 100 made of metal is disposed on the left side of the photosensitive drums 61 and the second frame made of resin is disposed on the right side of the photosensitive drums 61. The first frame may be disposed on the right side and the second frame may be disposed on the left side.

The above embodiment shows, but is not limited to, that the first frame 100 is provided with the gear shafts 121, 122 that support the gears 111, 112 of the drive force transmission mechanism 110. The first frame may not be provided with gear shaft. Instead, a metal plate provided with gear shafts may be fixed to the first frame.

The above embodiment shows, but is not limited to, the structures of the first electrode 210 and the second electrode 220. The unit-side contact member to be electrically connected to the image forming unit may be a plate-like member. The above embodiment shows, but is not limited to, that the unit-side contact members 211, 221 are held by the second frame 200 such that they are movable in the left-right direction. The unit-side contact members may be fixed to the second frame 200. The above embodiment shows, but is not limited to, that the electrodes are comprised of plural components including the unit-side contact members and the board-side contact members. The electrodes may be a single component, such as a coiled spring electrode. The electrodes may be connected to the board by wiring.

The above embodiment shows, but is not limited to, that the scanner plate 300 is illustrated as the first connecting member. The first connecting member may have a beam-like structure, such as the front beam 410 and the rear beam 420. The above embodiment shows, but is not limited to, that the front beam 410 and the rear beam 420 are illustrated as the second connecting member. The front beam 410 and the rear beam 420 may have a plate-like shape. The above embodiment shows, but is not limited to, that one first connecting member and two second connecting members. The number of the first and second connecting members may not be limited. The above embodiment shows, but is not limited to, that the first frame and the second frame are connected by the first and second connecting members. For example, with reference to FIG. 3, the scanner plate 300 may be fixed to the first frame 100 and the metal frame 230 fixed to the second frame 200 by welding.

The above embodiment shows, but is not limited to, that the light exposure unit 5 is supported by the first frame 100 and the metal frame 230 via the scanner plate 300. The light exposure unit may be directly fixed to the first frame 100 and the metal frame 230.

The above embodiment shows, but is not limited to, that the metal frame 230 made of two parts, the first metal frame 231 and the second metal frame 232. The metal frame may be a single part or made up of three or more parts. The above embodiment shows, but is not limited to, that the color laser printer 1 includes the metal frame 230. The color laser printer 1 may not include the metal frame.

The above embodiment shows, but is not limited to, that the side plates 60B of the holder 60 are made of metal. The side plates may be made of resin. The above embodiment shows, but is not limited to, that the holder 60 is made up of the holder frame 60A made of resin and the side plates 60B made of metal. The frames constituting the holder may be all made of resin or metal. The above embodiment shows, but is not limited to, that the holder 60 maintains the intervals between the photosensitive drums 61 in the arrangement direction by the side plates 60B. The holder may maintain the photosensitive drums with a slight play therebetween. In this case, the image forming apparatus is favorably configured such that, when the holder is attached to the main body, the intervals between the photosensitive drums in the arrangement direction are determined. The above embodiment shows, but is not limited to, that the process unit 6 as an example of the image forming unit has the holder 60. The image forming unit may not be include the holder.

The above embodiment shows, but is not limited to, that the plural photosensitive drums 61 arranged are illustrated as the image carrying member. The image carrying member may be a single photosensitive member. In other words, the image forming apparatus of the embodiment may be a monochrome printer including one photosensitive drum and being configured to form a monochrome image. The image carrying member may include a photosensitive belt, an intermediate transfer drum, and an intermediate transfer belt.

The above embodiment shows, but is not limited to, that the color laser printer 1 as an example of the image forming apparatus is configured to expose the photosensitive drums 61 with laser light from the light exposure unit 5. The image forming apparatus may be configured to expose the photosensitive drums with light emitted from light-emitting diodes, LEDs. The image forming apparatus may include a copier, a multifunction apparatus and other apparatus which include a document reader such as a flatbed scanner.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming unit including an image carrying member;

a drive force transmission mechanism configured to transmit a drive force to the image carrying member; and a main body configured to support the image forming unit, the main body including:

a first frame disposed on a first side of the image carrying member in an axial direction of the image carrying member, the first frame supporting the drive force transmission mechanism;

a second frame disposed on a second side of the image carrying member opposite to the first side thereof, the second frame and the first frame facing each other;

a first connecting member extending in the axial direction of the image carrying member, the first connecting member connecting the first frame and the second frame; and a second connecting member spaced apart from the first connecting member, the second connecting member connecting the first frame and the second frame, wherein the first frame of the main body is made of metal and the second frame of the main body is made of resin.

2. The image forming apparatus according to claim 1, wherein the second frame is provided with an electrode for supplying power to the image forming unit.

3. The image forming apparatus according to claim 2, further comprising a board disposed on a side of the second frame opposite to the image forming unit, wherein the second frame has an electrode holding portion formed therethrough in the axial direction, and wherein the electrode is held by the electrode holding portion of the second frame and connected to the board via the electrode holding portion.

4. The image forming apparatus according to claim 2, further comprising a board disposed on a side of the second frame opposite to the image forming unit, wherein the electrode includes a unit-side contact portion configured to electrically contact the image forming unit, a board-side contact portion configured to electrically contact the board, and an electrically conductive portion configured to provide electrical continuity between the unit-side contact portion and the board-side contact portion, and wherein the unit-side contact portion and the board-side contact portion are disposed at positions shifted from each other when viewed in the axial direction.

5. The image forming apparatus according to claim 1, wherein the drive force transmission mechanism includes a gear, and wherein the first frame is provided with a gear shaft configured to position the gear and rotatably support the gear.

6. The image forming apparatus according to claim 1, wherein the image carrying member includes a photosensitive drum, wherein the image forming unit includes the photosensitive drum and a further photosensitive drum arranged in an arrangement direction, and wherein the first connecting member and the second connecting member are spaced apart from the each other in a direction perpendicular to the arrangement direction when viewed in the axial direction of the image carrying member.

7. The image forming apparatus according to claim 6, wherein the image forming unit further includes a holder configured to hold the photosensitive drum and the further photosensitive drum and move relative to the main body in the arrangement direction, and wherein the photosensitive drum and the further photosensitive drum are supported by the first frame and the second frame via the holder.

8. The image forming apparatus according to claim 7, wherein the holder includes first and second side plates disposed on first and second sides of each of the photosensitive drum and the further photosensitive drum in the axial direction, respectively, and the first and second plates are configured to maintain the photosensitive drum and the further photosensitive drum at a specified interval in the arrangement direction.

9. The image forming apparatus according to claim 8, wherein the first and second side plates are made of metal.

10. The image forming apparatus according to claim 7, further comprising a metal frame fixed on a side of the second frame where the photosensitive drum and the further photosensitive drum are arranged, wherein the first frame and the metal frame are provided with respective positioning portions configured to position the holder attached to the main body.

11. The image forming apparatus according to claim 10, further comprising a light exposure unit configured to expose the photosensitive drum and the further photosensitive drum, the light exposure unit being supported by the first frame and the metal frame.

12. An image forming apparatus comprising:

a drive force transmission mechanism configured to a transmit a drive force; and a main body configured to support an image forming unit including an image carrying member, the image carrying member being configured to receive the drive force from the drive force transmission mechanism, the main body including:

a first frame disposed on a first side of the main body, the first frame supporting the drive force transmission mechanism;

a second frame disposed on a second side of the main body opposite to the first side thereof, the second frame and the first frame facing each other, the second frame being spaced apart from the first frame such that, when the main body supports the image forming unit, the image carrying member extends between the second frame and the first frame;

a first connecting member disposed on a third side of the main body, the first connecting member extending perpendicularly to the first frame and the second frame, the first connecting member connecting the first frame and the second frame; and a second connecting member disposed on a fourth side of the main body opposite to the third side, the second connecting member extending perpendicularly to the first frame and the second frame, the second connecting member connecting the first frame and the second frame, wherein the first frame of the main body is made of metal and the second frame of the main body is made of resin.

13. The image forming apparatus according to claim 12, wherein the second frame is provided with an electrode for supplying power to the image forming unit.

14. The image forming apparatus according to claim 12, wherein the main body is configured to support the image forming unit including a plurality of photosensitive drums arranged in an arrangement direction.

15. The image forming apparatus according to claim 12, wherein the first connecting member is disposed on an upper side of the main body and the second connecting member is disposed on a lower side of the main body.

* * * * *